US009636727B2

(12) United States Patent
Hisayuki et al.

(10) Patent No.: US 9,636,727 B2
(45) Date of Patent: May 2, 2017

(54) DEVICE FOR DRAWING TUBULAR WORKPIECE

(75) Inventors: Koji Hisayuki, Oyama (JP); Shigeru Aoya, Oyama (JP); Masaaki Oide, Oyama (JP)

(73) Assignee: SHOWA DENKO K.K., Minato-ku, Tokyo (JP)

( * ) Notice: Subject to any disclaimer, the term of this patent is extended or adjusted under 35 U.S.C. 154(b) by 929 days.

(21) Appl. No.: 13/059,681

(22) PCT Filed: Aug. 20, 2009

(86) PCT No.: PCT/JP2009/064540

§ 371 (c)(1),
(2), (4) Date: Apr. 28, 2011

(87) PCT Pub. No.: WO2010/021350

PCT Pub. Date: Feb. 25, 2010

(65) Prior Publication Data

US 2011/0296890 A1 Dec. 8, 2011

(30) Foreign Application Priority Data

Aug. 21, 2008 (JP) ..... 2008-213044

(51) Int. Cl.
*B21C 1/24* (2006.01)
*B21C 9/00* (2006.01)
(Continued)

(52) U.S. Cl.
CPC ..... *B21C 1/24* (2013.01); *B21C 3/04* (2013.01); *B21C 3/16* (2013.01); *B21C 9/005* (2013.01)

(58) Field of Classification Search
CPC .. B21C 1/24; B21C 3/02; B21C 37/16; B21C 3/16; B21C 3/00; B21C 1/34; B21C 1/32
(Continued)

(56) References Cited

U.S. PATENT DOCUMENTS 1,928,227 A * 9/1933 McCulloch ..... 72/276
3,605,476 A * 9/1971 Hinshaw ..... 72/274
(Continued)

FOREIGN PATENT DOCUMENTS

JP 02-112819 * 4/1990
JP 04-309409 A 11/1992
(Continued)

OTHER PUBLICATIONS

Official Communication issued in International Patent Application No. PCT/JP2009/064540, mailed on Oct. 13, 2009.

*Primary Examiner* — David Bryant
*Assistant Examiner* — Mohammad Yusuf
(74) *Attorney, Agent, or Firm* — Millen, White, Zelano & Branigan, P.C.; William Nixon

(57) ABSTRACT

A device 10 for drawing a tubular workpiece is provided with a drawing die 20 and a drawing plug 30. The drawing die 20 includes a first curved surface section 1C from which the workpiece 40 is detached while being reduced in diameter, a die bearing section 2B arranged radially inward of and downstream of a workpiece separation point K of the first curved surface section 1C, and a guide section 2D having a second curved surface section 2C which smoothly continues to an upstream end of the die bearing section 2B and configured to again come into contact with the workpiece 40 detached from the first curved bearing section 1C to guide the workpiece to the die bearing section 2B while reducing a diameter of the workpiece 40. The drawing plug 30 has a plug bearing section 3B shorter than a length L4 of the die bearing section 2B. The plug bearing section 3B is arranged at a position corresponding to the die bearing section 2B.

27 Claims, 5 Drawing Sheets

(51) Int. Cl.
*B21C 3/16* (2006.01)
*B21C 3/04* (2006.01)

(58) Field of Classification Search
USPC .... 72/283, 370.14, 276, 274, 467, 208–209, 72/370.25
See application file for complete search history.

(56) References Cited

U.S. PATENT DOCUMENTS

| | | | | | |
|---|---|---|---|---|---|
| 3,744,290 | A * | 7/1973 | Sirois | ..... | 72/283 |
| 3,783,663 | A * | 1/1974 | Prajsnar et al. | ..... | 72/283 |
| 4,200,051 | A * | 4/1980 | Nakahara et al. | ..... | 72/283 |
| 4,726,211 | A * | 2/1988 | Sunaga et al. | ..... | 72/283 |
| 4,856,703 | A * | 8/1989 | Uhlmann | ..... | 72/283 |
| 8,074,482 | B2 * | 12/2011 | Okui et al. | ..... | 72/283 |

FOREIGN PATENT DOCUMENTS

| | | | |
|---|---|---|---|
| JP | 08-066715 | A | 3/1996 |
| JP | 2005-118799 | A | 5/2005 |
| JP | 2005-279750 | A | 10/2005 |

* cited by examiner

DEVICE FOR DRAWING TUBULAR WORKPIECE

TECHNICAL FIELD

The present invention relates to a device for drawing a tubular workpiece, a drawing die, and a method of drawing a tubular workpiece, which are capable of obtaining a drawn tube having a high smooth outer surface.

In this specification and claims, the language of "aluminum" is used to include the meaning of both pure aluminum and aluminum alloy unless otherwise specifically defined. An "upstream side" and a "downstream side" are used to mean an upstream side and a down stream side of a drawing direction of the workpiece, respectively.

BACKGROUND ART

Conventionally, an aluminum tube having a surface roughness Ry of an outer surface being around 1.0 to 3.0 μm has been manufactured by, for example, subjecting an aluminum raw material (e.g., aluminum billet) to extrusion processing and drawing processing in this order. Such a drawn tube is called an "ED (Extrusion Drawing) tube." Such a drawn tube is used as, e.g., a photoconductive drum substrate for electrophotographic devices (e.g., copying machines, laser beam printers).

Japanese Unexamined Laid-open Patent Application Publication No. 2005-118799 (JP-A-2005-118799, hereinafter referred to as "Patent Document 1") discloses a drawing processing device (diameter-reducing processing device) equipped with a drawing die for reducing an outer diameter of a metal tube as a tubular workpiece (see Patent Document 1). This drawing processing device is not equipped with a drawing plug for processing an inner surface of a tube, which employs an empty drawing method. Therefore, the device is characterized in that the drawing processing causes an increase of a wall thickness of the tube. The purpose of this drawing processing device is to prevent an increase of the wall thickness of the tube without using a drawing plug and to prevent occurrence of chattering marks on an outer surface of the tube during the drawing processing.

Japanese Unexamined Laid-open Patent Application Publication No. H08-66715 (JP-A-H08-66715, hereinafter referred to as "Patent Document 2") discloses a method of producing a solid-core wire or rod, not a tubular member, by drawing processing. The workpiece used in this method is not a tubular member but a solid-core member. Therefore, the drawing processing device used in this method is not required to equip a drawing plug.

PRIOR ART DOCUMENTS

Patent Documents

[Patent Document 1] JP-A-2005-118799
[Patent Document 2] JP-A-H08 (1996)-66715

SUMMARY OF INVENTION

Problems to be Solved by the Invention

Drawing pipes are used for various kinds of purposes. For example, it is preferable that a drawn tube used as a photoconductive drum substrate mentioned above has a mirror finished outer surface. Conventionally, an outer surface of a drawn tube was subjected to a cutting work to obtain a mirror finished surface. Such a drawn tube having an outer surface subjected to a cutting work is called a "cutting tube." On the other hand, a cutting tube having an outer surface not subjected to a cutting work is called a "non-cutting tube."

A cutting tube had a problem that the production cost was expensive due to the necessity of cutting work on the outer surface of the tube. To reduce the production cost, it is required to use a non-cutting tube in place of a cutting tube.

However, a non-cutting tube has a number of oil pits as dented defects generated during the drawing processing on the outer surface of the tube. Thus, it was very difficult to obtain a non-cutting tube having a high smooth outer surface with a surface roughness Ry of, e.g., 1.0 μm or less.

Under the circumstances, the present inventors devotedly examined the cause of generation of oil pits and found the following findings. These findings will be explained as follows with reference to FIGS. 4 and 5.

As shown in FIG. 4, the reference numeral "110" denotes a conventional device for drawing a tubular workpiece. This drawing device 110 is equipped with a drawing die 120 for processing the outer surface 40*a* of the workpiece 40 and a drawing plug 130 for processing the inner surface 40*b* of the workpiece 40. The drawing plug 130 can be formed into a generally ball or spherical shape. The drawing plug 130 is attached to the tip end portion of the supporting rod 131 and arranged inside the hollow portion 40*c* of the workpiece 40. As shown in FIG. 5, on the peripheral surface of the die hole 121 of the drawing die 120, a curved surface section 101C circular in vertical cross-section is continuously and smoothly formed at the downstream end of the die approach section 101A, and this curved surface section 101C is continuously and smoothly formed at the upstream end F of the die bearing section 101B. The die approach section 101A and the curved surface section 101C are formed so that the diameter thereof gradually decreases as it advances toward the downstream side of the drawing direction N of the workpiece 40. In the cross-section including the die axis X of the drawing die 120, the inclination of the tangent line of the curved surface section 101C with respect to the die axis X of the drawing die 120 gradually decreases as it advances in the drawing direction of the workpiece 40. The die bearing section 101B is formed generally in parallel to the die axis X of the drawing die 120. The reference numeral "102E" denotes a relief section. In FIGS. 4 and 5, the workpiece 40 is depicted with dotted-hatching for an easy discrimination from other members.

When drawing a tubular workpiece 40 using the drawing device 110, the workpiece 40 comes into contact with the die approach section 101A or the curved surface section 101C of the drawing die 120 and is guided from the curved surface section 101C to the die bearing section 101B while being reduced in diameter with the curved surface section 101C. The workpiece 40 passes through between the die bearing section 101B and the plug bearing section 103B of the drawing plug 130, whereby the outer surface 40*a* and the inner surface 40*b* of the workpiece 40 are simultaneously finish-processed with the die bearing section 101B and the plug bearing section 103B. During the finish processing, the workpiece 40 is pressurized by the die bearing section 101B and the plug bearing section 103B, so that the thickness of the workpiece 40 is reduced. Through the aforementioned material flow of the workpiece 40, a drawn tube 41 is obtained.

In such a material flow of the workpiece 40, as generally explained in a drawing processing textbook, it was conventionally believed that the workpiece 40 brought into contact with the curved surface section 101C of the drawing die 120 was guided from the curved surface section 101C to the die bearing section 101B in a state in which the workpiece 40 was kept in contact with the curved surface section 101C. In the actual drawing processing, however, the aforementioned material flow of the workpiece 40 does not occur. In detail, as shown in FIG. 5, the workpiece 40 brought into contact with the curved surface section 101C is once detached from the curved surface section 101C before being guided to the die bearing section 101B, and then again comes into contact with the die bearing section 101B. For this reason, in the middle of moving of the workpiece from the curved surface section 101C to the die bearing section 101B, the workpiece 40 is excessively reduced in diameter. This causes an arc-shaped deformation in a vertical cross-section, which in turn generates a number of terrific minute irregularities (not illustrated) on the outer surface 40*a*. Drawing processing lubrication oil will be caught in the dented portions of the terrific irregularities. In this state, when the workpiece 40 passes through between the die bearing section 101B and the plug bearing section 103B, the outer surface 40*a* and the inner surface 40*b* of the workpiece 40 will be pressurized with the die bearing section 101B and the plug bearing section 103B. As a result, a number of minute oil-pits (not illustrated) are formed on the outer surface 41*a* of the drawn pipe 41. Such oil-pits cause a rough outer surface 41*a* of the drawn pipe 41. The inventors obtained the above-mentioned findings.

The preferred embodiments of the present invention have been developed in view of the above-mentioned and/or other problems in the related art. The preferred embodiments of the present invention can significantly improve upon existing methods and/or apparatuses.

The present invention was made in view of the above-mentioned technical background and the aforementioned findings obtained by the inventors, and aims to provide a device for drawing a tubular workpiece, a drawing die preferably used in the device, and a method of drawing a tubular workpiece, which are capable of obtaining a drawn tube having a smooth outer surface.

Other purposes and advantages of the present invention will be apparent from the following preferred embodiments.

Means for Solving the Problems

The present invention provides the following means.

[1] A device for drawing a tubular workpiece, comprising:

a drawing die for processing an outer surface of the tubular workpiece; and a drawing plug arranged in a hollow portion of the workpiece to process an inner surface of the workpiece, wherein the drawing die includes:

a first curved surface section from which the workpiece is detached while being reduced in diameter;

a die bearing section arranged radially inward of and downstream of a workpiece separation point of the first curved surface section; and a guide section having a second curved surface section smoothly continuing to an upstream end of the die bearing section and configured to again come into contact with the workpiece detached from the first curved bearing section to guide the workpiece to the die bearing section while reducing a diameter of the workpiece, and wherein the drawing plug has a plug bearing section arranged at a position corresponding to the die bearing section and shorter than the die bearing section.

[2] The device for drawing a tubular workpiece as recited in the aforementioned Item 1, wherein a position of an upstream end of the plug bearing section is arranged at the same as or at a downstream side of a position of an upstream end of the die bearing section.

[3] The device for drawing a tubular workpiece as recited in the aforementioned Item 1 or 2, wherein in a cross-section including a die axis of the drawing die, an inclination of a tangent line of the first curved surface section with respect to the die axis of the drawing die and an inclination of a tangent line of the second curved surface section with respect to the die axis of the drawing die each gradually decrease as it advances in a drawing direction of the workpiece.

[4] The device for drawing a tubular workpiece as recited in any one of the aforementioned Items 1 to 3, wherein a curvature radius of the second curved surface section is set to be equal to or smaller than a curvature radius of the first curved surface section.

[5] The device for drawing a tubular workpiece as recited in any one of the aforementioned Items 1 to 4, wherein the guide section includes an auxiliary curved surface section which smoothly continues to an upstream end of the second curved surface section and curves in a direction opposite to a curving direction of the second curved surface section.

[6] The device for drawing a tubular workpiece as recited in any one of the aforementioned Items 1 to 5, wherein a length of the plug bearing section is set so as to fall within a range of 5 to 70% of a length of the die bearing section.

[7] The device for drawing a tubular workpiece as recited in any one of the aforementioned Items 1 to 6, wherein a parallel accuracy of the die bearing section with respect to the die axis of the drawing die is set so as to fall within ±3°.

[8] The device for drawing a tubular workpiece as recited in any one of the aforementioned Items 1 to 7, wherein a parallel accuracy of the plug bearing section with respect to the die axis of the drawing die is set so as to fall within ±3°.

[9] The device for drawing a tubular workpiece as recited in any one of the aforementioned Items 1 to 8, wherein a length of the die bearing section is 5 mm or more.

[10] The device for drawing a tubular workpiece as recited in any one of the aforementioned Items 1 to 9, wherein a redial difference between the workpiece separation point of the first curbed surface section and the die bearing section in a radial direction of the drawing die is set to be 0.3 mm or more but less than 3 mm.

[11] The device for drawing a tubular workpiece as recited in any one of the aforementioned Items 1 to 10, wherein the first curved surface section, the guide section, and the die bearing section of the drawing die are integrally formed.

[12] The device for drawing a tubular workpiece as recited in any one of the aforementioned Items 1 to 11, wherein the drawing plug is provided with a third curved surface section which smoothly continues to an upstream end of the plug bearing section.

[13] The device for drawing a tubular workpiece as recited in any one of the aforementioned Items 1 to 12, further comprising a pulling device for pulling the workpiece in a drawing direction so that a drawing rate falls within a range of 10 to 100 m/min.

[14] A drawing die for processing an outer surface of a tubular workpiece, comprising:

a first curved surface section from which the workpiece is detached while being reduced in diameter;

a die bearing section arranged radially inward of and downstream of a workpiece separation point of the first curved surface section; and a guide section having a second curved surface section which smoothly continues to an upstream end of the die bearing section and configured to again come into contact with the workpiece detached from the first curved surface section to guide the workpiece to the die bearing section while reducing a diameter of the workpiece.

[15] The drawing die as recited in the aforementioned Item 14, wherein the drawing die is used in combination with a drawing plug disposed in a hollow portion of the workpiece to process an inner surface of the workpiece.

[16] A method of drawing a tubular workpiece using the device for drawing a tubular workpiece as recited in any one of the aforementioned Items 1 to 13.

[17] A method of drawing a tubular workpiece with a drawing device equipped with a drawing die for processing an outer surface of the tubular workpiece and a drawing plug arranged in a hollow portion of the workpiece to process an inner surface of the workpiece, the method comprising the steps of:

detaching the workpiece from a first curved surface section of the drawing die while reducing a diameter of the workpiece; then guiding the workpiece to a die bearing section which smoothly continues to a second curbed surface section of the guide section while reducing the diameter of the workpiece by again bringing the workpiece into contact with the guide portion of the drawing die; and making the workpiece pass between the die bearing section and a plug bearing section of the drawing plug to process an outer surface of the workpiece.

[18] The method of drawing a tubular workpiece as recited in the aforementioned Item 17, wherein the die bearing section is arranged radially inward of and downstream of a workpiece separation point of the first curved surface section, wherein a length of the plug bearing section is set to be shorter than a length of the die bearing section, and wherein a position of an upstream end of the plug bearing section is arranged at the same as or at a downstream side of a position of an upstream end of the die bearing section.

[19] The method of drawing a tubular workpiece as recited in the aforementioned Item 17 or 18, wherein in a cross-section including a die axis of the drawing die, an inclination of a tangent line of the first curved surface section with respect to the die axis of the drawing die and an inclination of a tangent line of the second curved surface section with respect to the die axis of the drawing die each gradually decrease as it advances in a drawing direction of the workpiece.

[20] The method of drawing a tubular workpiece as recited in any one of the aforementioned Items 17 to 19, wherein a curvature radius of the second curved surface section is set to be equal to or smaller than a curvature radius of the first curved surface section.

[21] The method of drawing a tubular workpiece as recited in any one of the aforementioned Items 17 to 20, wherein the guide section includes an auxiliary curved surface section which smoothly continues to an upstream end of the second curved surface section and curves in a direction opposite to a curving direction of the second curved surface section.

[22] The method of drawing a tubular workpiece as recited in any one of the aforementioned Items 17 to 21, wherein a length of the plug bearing section is set so as to fall within a range of 5 to 70% of a length of the die bearing section.

[23] The method of drawing a tubular workpiece as recited in any one of the aforementioned Items 17 to 22, wherein a parallel accuracy of the die bearing section with respect to the die axis of the drawing die is set so as to fall within ±3°.

[24] The method of drawing a tubular workpiece as recited in any one of the aforementioned Items 17 to 23, wherein a parallel accuracy of the plug bearing section with respect to the die axis of the drawing die is set so as to fall within ±3°.

[25] The method of drawing a tubular workpiece as recited in any one of the aforementioned Items 17 to 24, wherein a length of the die bearing section is 5 mm or more.

[26] The method of drawing a tubular workpiece as recited in any one of the aforementioned Items 17 to 25, wherein in a radial direction of the drawing die, a radial difference between the workpiece separation point of the first curbed surface section and the die bearing section is set to be 0.3 mm or more but less than 3 mm.

[27] The method of drawing a tubular workpiece as recited in any one of the aforementioned Items 17 to 26, wherein the first curved surface section, the guide section, and the die bearing section of the drawing die are integrally formed.

[28] The method of drawing a tubular workpiece as recited in any one of the aforementioned Items 17 to 27, wherein the drawing plug is provided with a third curved surface section which smoothly continues to an upstream end of the plug bearing section.

[29] The method of drawing a tubular workpiece as recited in any one of the aforementioned Items 17 to 28, wherein the drawing of the workpiece is performed in a state in which a drawing rate is set so as to fall within a range of 10 to 100 m/min.

Effects of the Invention

The present invention exerts the following effects.

According to the drawing device of the present invention [1], the tubular workpiece is detached from the first curved surface section of the drawing die while being reduced in diameter by the first curved surface section so that the tubular workpiece is guided toward the guide section. Then, the tubular workpiece is again brought into contact with the guide section, then introduced to the die bearing section from the guide section while being reduced in diameter by the guide section, and thereafter passes through between the die bearing section and the plug bearing section of the drawing plug. Thus, the inner surface and the outer surface of the workpiece are processed.

In the material flow of the aforementioned workpiece, since the die bearing section of the drawing die is arranged inward of the workpiece separation point of the first curved surface section, the workpiece can be prevented form being reduced in diameter excessively when the workpiece is moved from the first curved surface section to the die bearing section.

Furthermore, since the second curved surface section of the guide section is smoothly continued to the upstream end of the die bearing section, the workpiece again brought into contact with the guide section can be moved smoothly toward the die bearing section via the second curved surface section.

In addition, since the length of the plug bearing section of the drawing plug is set to be shorter than the length of the die bearing section of the drawing die, a pressure required to process the workpiece to obtain a high smooth outer surface can be assuredly applied to the workpiece from both the plug bearing section and the die bearing section.

The synergistic function of the aforementioned effects enables processing of the outer surface of the workpiece into a high smooth surface.

According to the invention [2], it can be assuredly prevented that the workpiece again brought into contact with the guide section of the drawing die is excessively reduced in diameter when the workpiece is moved from the guide section to the die bearing section, and a pressure required to process the workpiece to obtain a high smooth outer surface can be more assuredly applied to the workpiece from both the plug bearing section and the die bearing section. This enables assured processing of the workpiece to obtain a high smooth surface of the outer surface.

According to the invention [3], the workpiece can be assuredly reduced in diameter with the first curved surface section, and the workpiece again brought into contact with the guide section can be assuredly guided to the die bearing section.

According to the invention [4], the drawn amount of the lubrication oil to be drawn in between the outer surface of the workpiece and the drawing die can be secured, and further the surface pressure applied to the outer surface of the workpiece from the second curved surfaced section can be increased, which further prevents generation of oil-pits. As a result, the outer surface of the workpiece can be processed into a high smooth surface more assuredly.

According to the invention [5], the guide section includes an auxiliary curved surface section which smoothly continues to an upstream end of the second curved surface section and curves in a direction opposite to a curving direction of the second curved surface section, enabling assured receiving of the workpiece detached from the first curved surface section with the guide section, which in turn can assuredly guide the workpiece from the guide section to the die bearing section.

According to the invention [6], since the length of the plug bearing section is set to be 5% or more of the length of the die bearing section, a pressure required to process the workpiece to obtain a high smooth outer surface can be more assuredly applied to the workpiece from both the plug bearing section and the die bearing section. Thus, the outer surface of the workpiece can be processed into a high smooth surface more assuredly. Furthermore, since the length of the plug bearing section is set to be 70% or less of the length of the die bearing section, the possible breakage of the workpiece which may cause due to the contact friction between the workpiece and the plug bearing section can be prevented assuredly.

According to the invention [7], a parallel accuracy of the die bearing section with respect to the die axis of the drawing die is set so as to fall within ±3°, which enables processing of the workpiece to obtain a high smooth surface more assuredly.

According to the invention [8], in the same manner as in the invention [7], the workpiece can be more assuredly processed to have a high smooth outer surface.

According to the invention [9], the workpiece can be more assuredly processed into a high smooth outer surface.

According to the invention [10], the radial difference between the workpiece separation point of the first curbed surface section and the die bearing section in a radial direction of the drawing die is set to be 0.3 mm or more, which assuredly prevents the workpiece from being excessively reduced in diameter when the workpiece is moved from the first curved surface section to the die bearing section. Furthermore, since the difference is set to be 3 mm or less, when the workpiece again brought into contact with the guide section is guided to the die bearing section, the workpiece can be assuredly prevented from being detached from the die bearing section. Thus, the workpiece can be more assuredly processed into a high smooth outer surface.

According to the invention [11], the first curved surface section, the guide section, and the die bearing section of the drawing die are integrally formed, which prevents the axial misalignment between the axis of the first curved surface section and the die bearing section. This enhances the coaxiality of the drawing die.

According to the invention [12], the workpiece brought into contact with the third curved surface section of the drawing plug can be smoothly moved toward the plug bearing section. Thus, the outer surface of the workpiece can be more assuredly processed into a high smooth surface.

According to the invention [13], by pulling the workpiece with the pulling device at a drawing rate of 10 m/min or more, the drawing processing efficient can be improved. By pulling the workpiece with the pulling device at a drawing rate of 100 m/min or less, the amount of the lubrication oil drawn in between the outer surface of the workpiece and the drawing die can be prevented from being increased excessively. This prevents the generation of oil-pits more assuredly, which in turn can process the workpiece to have a high smooth surface more assuredly.

According to the invention [14] and [15], a drawing die capable of processing a tubular workpiece into a high smooth outer surface thereof can be provided.

According to the invention [16], a workpiece can be processed into a high smooth outer surface, which makes it possible to produce a drawn tube having a high smooth outer surface.

According to the invention [17], by the same reason as in the invention [1], a tubular workpiece can be processed so that the workpiece has a high smooth outer surface, which in turn can produce a drawn tube having a high smooth outer surface.

According to the invention [18] to [29], the same effects as those of the invention [2] to [13] can be exerted.

EMBODIMENTS FOR CARRYING OUT THE INVENTION

Next, some embodiments of the present invention will be explained below with reference to drawings.

Figure 1:
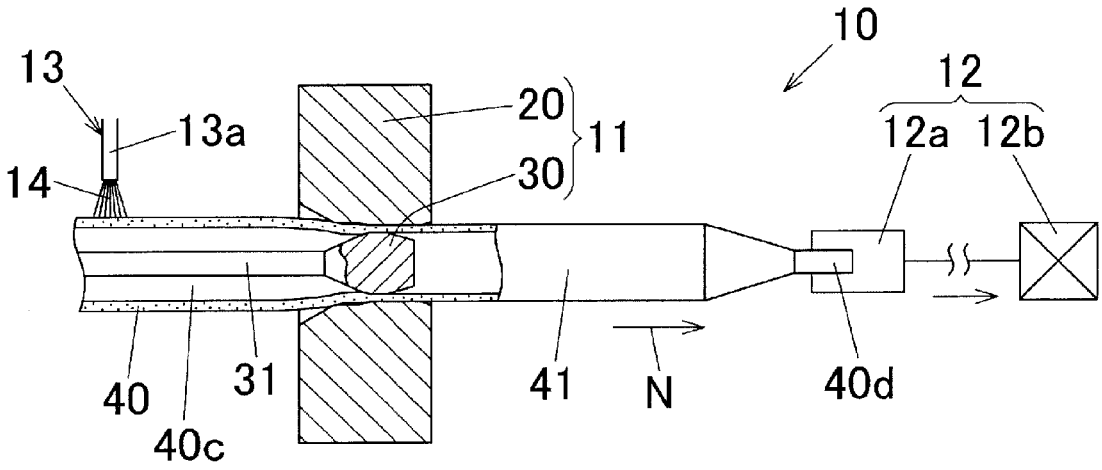
FIG. 1 is a schematic entire view of a device for drawing a tubular workpiece according to one of embodiments of the present invention.
Figure 2:
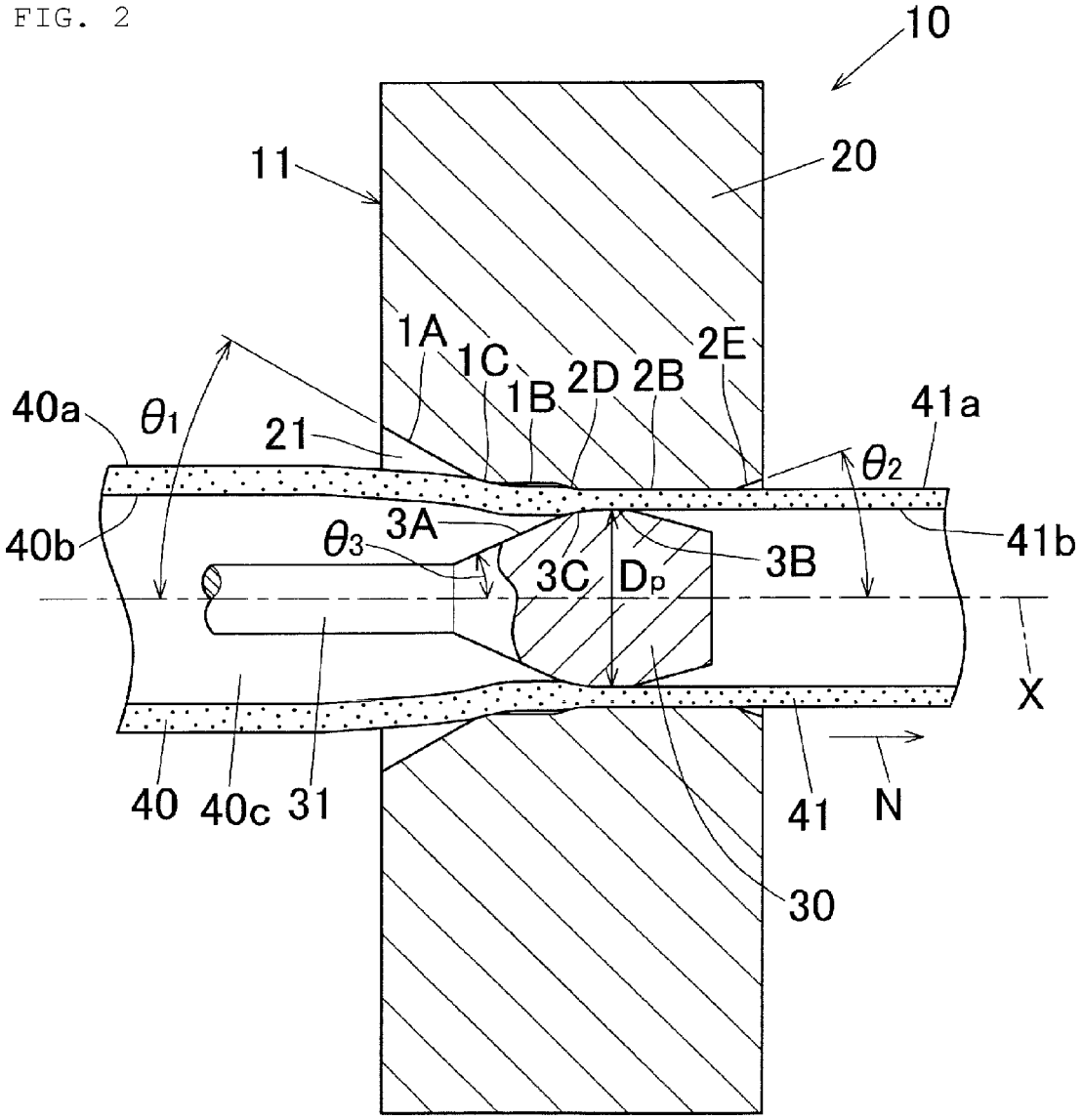
FIG. 2 is a vertical cross-sectional view of the drawing die and the drawing plug in a state in which a workpiece is being drawn by the drawing device.
Figure 3:
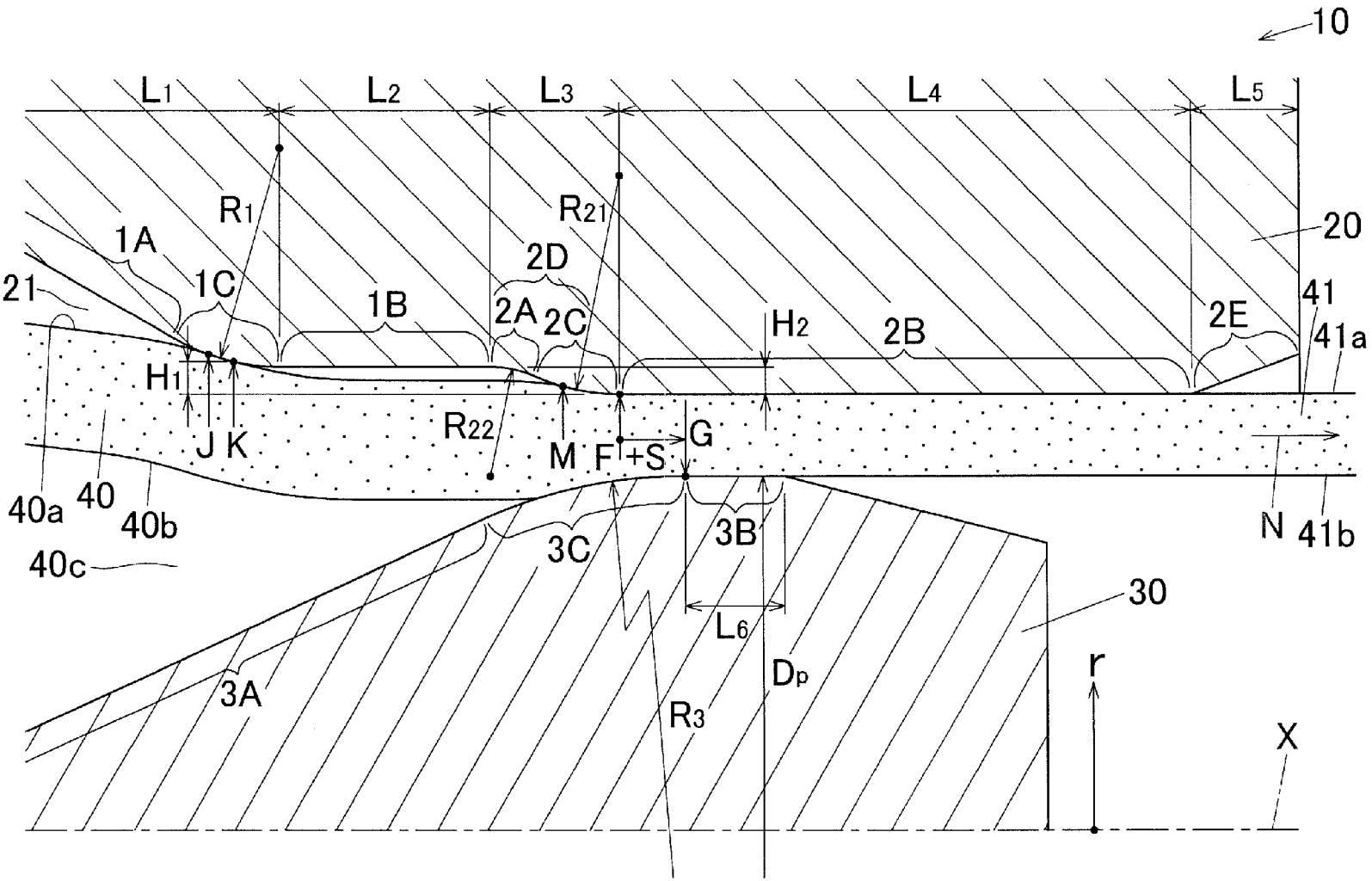
FIG. 3 is an enlarged view of FIG. 2.

FIGS. 1 to 3 are explanatory drawings of a device for drawing a tubular workpiece according to one embodiment of the present invention. In these figures, the reference numeral "10" denotes a drawing device of this embodiment.

This drawing device 10 is configured to execute drawing processing of a tubular workpiece 40 as shown in FIGS. 1 and 2. A tubular workpiece 40 is drawn with this drawing device 10 to thereby produce a drawn tube 41. This drawn tube 41 is used as a tube required to have a high smooth outer surface 41*a*, and can be preferably used as a photoconductive drum substrate of an electrophotographic device (e.g., copying machine, laser beam printer). On the outer surface of the photoconductive drum substrate, a prescribed film such as an OPC (organic photo conductor) is coated. Therefore, the workpiece 40 can be considered to be a raw tube for a photoconductive drum substrate.

The workpiece 40 is, for example, a metal extruded pipe (e.g., aluminum extruded pipe) obtained by extruding a metal billet (e.g., aluminum billet) as a raw material. The cross-sectional shape of the workpiece 40 is an annular shape. The workpiece 40 is set to have an outer diameter of, for example, 15 to 50 mm and a wall thickness of, for example, 0.5 to 2 mm.

The material of the workpiece 40 is metal, such as, e.g., iron, steel, copper, magnesium (including the alloy), and aluminum (including the alloy). It is especially preferable that the material is aluminum.

In this embodiment, the workpiece 40 is drawn with a drawing device 10 while setting the diameter reduction rate of the workpiece 40 to, for example, 10 to 20%, to thereby produce a drawn tube 41 having an annular cross-section. At this time, the wall thickness of the drawn tube 41 is reduced to, for example, 60 to 90% with respect to the wall thickness of the workpiece 40.

The diameter reduction rate Q of the workpiece 40 (more specifically, the diameter reduction rate of the outer diameter of the workpiece 40) is calculated by the following formula (I), wherein D0 is an outer diameter of the workpiece 40 before the drawing processing, and D1 is an outer diameter of the workpiece 40 (i.e., drawn tube 41) after the drawing processing.

$$Q=[1-(D1/D0)]\times 100\% \quad (1)$$

As shown in FIGS. 1 and 2, the drawing device 10 of this embodiment is, not of a non-plug drawing type, but of a plug drawing type. Therefore, this drawing device 10 is equipped with a drawing processing tool 11 including a drawing die 20 and a drawing plug 30, and further equipped with a pulling device 12 and the lubrication oil supplying device 13.

The drawing die 20 is configured to process the outer surface 40*a* of the workpiece 40, and is fixedly held by a die holder (not illustrated). The material of the drawing die 20 can be, for example, super hard steel, die steel, high-speed tool steel, or ceramics. The structure of this drawing die 20 will be detailed later.

The drawing plug 30 is configured to be arranged in the hollow portion 40*c* of the workpiece 40 to process the inner surface 40*b* of the workpiece 40, and is fixedly attached to the tip end portion of the supporting bar 31 for supporting the drawing plug 30. The shape of the drawing plug 30 can be formed into approximately a spherical or ball shape. The material of the drawing plug 30 can be, for example, superhard steel, die steel, high-speed tool steel, or ceramics. The structure of this drawing plug 30 will be detailed later.

As shown in FIG. 1, the pulling device 12 is configured to pull the workpiece 40 in the drawing direction N, and equipped with a chucking portion 12*a* and a driving source 12*b* which applies a pulling force in the drawing direction N to the chucking portion 12*a*. The chucking portion 12*a* is designed to chuck the metal pointed portion 40*d* formed at the tip end of the workpiece 40. As the driving source 12*b*, a hydraulic cylinder, etc., can be used. The drawing direction N of the workpiece 40 is defined as a direction extending along the die axis X of the drawing die 20.

The lubrication oil supplying device 13 is configured to supply a drawing processing lubrication oil 14 onto the outer surface 40*a* of the workpiece 40 so that the lubrication oil 14 adheres to the outer surface 40*a*, and has a nozzle 13*a* for spraying the lubrication oil 14 to the outer surface 40*a* of the workpiece 40. The nozzle 13*a* is arranged at the upstream side of the drawing die 20.

The lubrication oil 14 is not limited to a specific oil, and can be, for example, an oil available under the product name of "Daphne Master Draw" made by Idemitsu Kosan Co., Ltd., an oil available under the product name of "Sundraw" made by Sugimura Chemical Industrial Co., Ltd. or an oil available under the product name of "Strol" made by Kyoei Yuka Co., Ltd. The kinematic viscosity of the lubrication oil 14 is not specifically limited, but it is preferable that the kinematic viscocity at 40° C. (degree centigrade) is 300 to 500 $mm^2/s$.

The structure of the drawing die 20 is as follows.

As shown in FIGS. 2 and 3, the drawing die 20 is used in combination with the drawing plug 30 arranged inside the die hole 21, and has a die approach section 1A, a first curved surface section 1C, a transition section 1B, a guide section 2D, a die bearing section 2B, and a relief section 2E. These sections 1A, 1C, 1B, 2D, 2B, and 2E are formed on the peripheral surface of the die hole 21 of the drawing die 20 in this order in the drawing direction N of the workpiece 40. Furthermore, these sections are not separated individually, but integrally formed. All of the surfaces of these sections are polished into mirror finished surfaces.

The die approach section 1A is formed so that the diameter thereof gradually decreases toward the downstream side in the drawing direction N of the workpiece 40. More specifically, the die approach section 1A is formed into a conical tapered shape.

The inclination angle of the die approach section 1A with respect to the die axis X of the drawing die 20, or the die approach half angle θ1, is set to, for example, 20 to 40° (degrees) (see FIG. 2).

The first curved surface section 1C is formed at the downstream side of the die approach section 1A so as to extend in a smoothly continuous manner from the die approach section 1A. In other words, the first curved section 1C is formed continuously from the die approach section 1A such that no step or angle is formed at the downstream side of the die approach section 1A. Furthermore, the first curved surface portion 1C is formed such that the diameter decreases gradually toward the downstream side in the drawing direction N of the workpiece 40. In a cross-section including the die axis X of the drawing die 20, the inclination of the tangent line of the first curved section 1C with respect to the die axis X of the drawing die 20 gradually decreases as it advances in the drawing direction N of the workpiece 40. The vertical cross-sectional shape of the first curved surface section 1C is a circular arc shape. In this specification, the vertical cross-section denotes a cross-section including the die axis X of the drawing die 20, or the cross-section shown in FIGS. 2 and 3.

The curvature radius R1 of the first curved surface section 1C is set to, for example, 1 to 10 mm.

The die approach section 1A and the first curved surface section 1C are sections for initially executing the diameter-reducing processing of the workpiece 40 (more specifically, diameter-reducing processing of the outer surface 40*a* of the workpiece 40). The first curved surface section 1C is a section from which the workpiece 40 is detached while being reduced in diameter.

The total length L1 of the die approach section 1A and the first curved surface section 1C, which is parallel to the die axis X, is set to, for example, 10 to 50 mm.

The position where the workpiece 40 (more specifically, the outer surface 40*a* of the workpiece 40) is initially brought into contact with the die approach section 1A or the first curved surface section 1C is defined as "J." The position where the workpiece 40 is detached from the first curved surface section 1C while being reduced in diameter is defined as "K."In this embodiment, the workpiece 40 initially comes into contact not with the die approach section 1A but with the first curved surface section 1C. In this invention, however, the workpiece 40 can be initially brought into contact with the die approach section 1A.

The die bearing section 2B is arranged radially inner than (i.e., arranged at the die axis X side of) the workpiece separation point K of the first curved surface section 1C at the downstream side with a distance from the first curved surface section 1C. The die bearing section 2B is a section for executing the finish processing of the outer surface 40*a* and defining the outer diameter size of the workpiece 40, and formed approximately in parallel to the die axis X.

The parallel accuracy of the die bearing section 2B with respect to the die axis X is set so as to fall within ±3°.

The length L4 of the die bearing section 2B, more specifically the length L4 of the die bearing section 2B parallel to the die axis X, is set to, for example, 3 to 15 mm, preferably 5 mm or more.

The radial difference H1 between the workpiece separation point K of the first curbed surface section 1C and the die bearing section 2B in a radial direction "r" of the drawing die 20 can be set arbitrarily. It is preferable that the difference is set to be 0.3 mm or more but less than 3 mm.

The guide section 2D is a section for guiding the workpiece 40 (more specifically the outer surface 40*a* of the workpiece 40) detached from the first curved surface section 1C while reducing the diameter of the workpiece 40 by again coming into contact with the workpiece 40. This guide section 2D is formed so that the diameter thereof gradually decreases toward the downstream side of the drawing direction N of the workpiece 40. The position where the workpiece 40 again comes into contact with the guide section 2D is defined as "M."

This guide section 2D has a second curved surface section 2C circular arc in vertical cross-section smoothly continuing to the die bearing section 2B at the upstream end F of the die bearing section 2B, and an auxiliary curved surface section 2A circular arc in vertical cross-section smoothly continuing to the second curved surface section 2C at the upstream end of the second curved surface section 2C.

In the cross-section including the die axis X of the drawing die 20, the inclination of the tangent line of the second curved surface section 2C with respect to the die axis X of the drawing die 20 gradually decreases as it advances in the drawing direction N of the workpiece 40. On the other hand, the auxiliary curved surface section 2A is curved in a direction opposite to the curving direction of the second curved surface section 2C. Therefore, in the cross-section including the die axis X of the drawing die 20, the inclination of the tangent line of the auxiliary curved surface section 2A with respect to the die axis X of the drawing die 20 gradually increases as it advances in the drawing direction N of the workpiece 40.

The length L3 of the guide section 2D parallel to the die axis X is set to, for example, 2 to 5 mm. The curvature radius R21 of the second curved surface section 2C is set to, for example, 1 to 10 mm. The curvature radius R22 of the auxiliary curved surface section 2A is set to, for example, 1 to 10 mm. Furthermore, the curvature radius R21 of the second curved surface section 2C is set to equal to or smaller than the curvature radius R1 of the first curved surface section 1C (i.e., R21≤R1).

The transition section 1B is a section arranged between the first curved surface section 1C and the guide section 2D to connect the first curved surface section 1C and the guide section 2D. In this embodiment, the transition section 1B integrally connects the first curved surface section 1C and the guide section 2D. Therefore, the first curved surface section 1C and the guide section 2D are integrally formed via the transition section 1B. Furthermore, the transition section 1B is formed to be approximately parallel to the die axis X to prevent the contact of the workpiece 40 during the drawing processing. The upstream end of the transition section 1B is smoothly connected to the downstream end of the first curved surface section 1C. Further, the downstream end of the transition section 1B is smoothly connected to the upstream end of the guide section 2D (more specifically, the auxiliary curved surface section 2A of the guide section 2D).

The length L2 of the transition section 1B parallel to the die axis X is set to, for example, 3 to 10 mm.

In the radial direction "r" of the drawing die 20, the radial difference H2 between the transition section 1B and the die bearing section 2B is set to be equal to or slightly smaller than the aforementioned radial difference H1 (i.e., H2≤H1). In general, the difference between H2 and H1 is very small. Therefore, it can be normally treated such that H2 and H1 are equal with each other although they are different in a strict sense.

The relief section 2E is a section for defining a workpiece outlet section of the drawing die 20, and is formed such that the diameter thereof gradually increases toward the downstream side of the drawing direction N of the workpiece 40 to prevent the contact of the workpiece 40 (more specifically, the drawn tube 41). The inclination angle of the relief section 2E with respect to the die axis X, i.e., the relief half-angle θ2 of the relief section 2E, is set to, for example, 20 to 40° (degrees) (see FIG. 2).

The length L5 of the relief section 2E, which is parallel to the die axis X, is set to, for example, 2 to 10 mm.

The structure of the drawing plug 30 is as follows.

The drawing plug 30 is arranged with the axis thereof aligned with the die axis X of the drawing die 20, and includes a plug approach section 3A, a third curves surface section 3C, and the plug bearing section 3B. These sections 3A, 3C and 3B are formed on the peripheral surface of the drawing plug 30 in this order in the drawing direction N of the workpiece 40. Furthermore, these sections are not separated individually, but integrally formed. All of the surfaces of these sections are polished into mirror finished surfaces.

The plug bearing section 3B is a section for executing the finish processing of the inner surface 40*b* of the workpiece 40 to define the inner diameter size, and arranged at the position corresponding to the die bearing section 2B of the drawing die 20, more specifically arranged so as to face the die bearing section 2B approximately in parallel to the die axis X. The position of the upstream side end G of the plug bearing section 3B is arranged at the same position as or downstream side of the upstream end F of the die bearing section 2B with respect to the drawing direction N of the workpiece 40. In FIG. 3, "S" denotes a shift amount of the position of the upstream end G of the plug bearing section 3B shifted toward the downstream side with respect to the position of the upstream end F of the die bearing section 2B. Accordingly, as shown in FIG. 3, when the position of the upstream end G of the plug bearing section 3B is shifted toward the downstream side with respect to the position of the upstream end F of the die bearing section 2B, the sign of the shift amount S is "+(positive)." To the contrary, when the position of the upstream end G of the plug bearing section 3B is shifted toward the upstream side, the sign of the shift amount S will be "−(negative)." This shift amount S is set so as to fall within the range of −5 to 5 mm, preferably −1 to 3 mm, more preferably 0 to 2 mm.

The parallel accuracy of the die bearing section 3B with respect to the die axis X is set so as to fall within ±3°.

The length L6 of the plug bearing section 3B, more specifically the length L6 of the plug bearing section 3B parallel to the die axis X, is set to be shorter than the length L4 of the die bearing 2B (i.e., L6<L4). Furthermore, this length L6 is preferably set so as to fall within the range of 5 to 70%, more preferably 6 to 30%, with respect to the length L4 of the die bearing section 2B. "Dp" denotes a diameter of the plug bearing section 3B of the drawing plug 30.

The plug approach section 3A is formed such that the diameter thereof gradually increases toward the downstream side of the drawing direction N of the workpiece 40. More specifically, it is formed into a conical tapered shape.

The inclination angle of the plug approach section 3A with respect to the die axis X, or the plug approach half-angle θ3, is set to, for example, 5 to 30° (degrees) (see FIG. 2).

The third curved surface section 3C is arranged between the plug approach section 3A and the plug bearing section 3B so as to smoothly connect the plug approach section 3A and the plug bearing section 3B. In detail, this third curved surface section 3C is formed so as to smoothly continue to the upstream end G of the plug bearing section 3B. At the upstream end of this third curved surface section 3C, the die approach section 3A is smoothly connected. In the cross-section including the die axis X of the drawing plug 30, the inclination of the tangent line of the third curved surface section 3C with respect to the die axis X is set to gradually decrease as it advances in the drawing direction N of the workpiece 40. In detail, the vertical cross-sectional shape of the third curved surface section 3C is a circular arc shape.

The curvature radius R3 of the third curved surface section 3C is set to, for example, 10 to 60 mm.

The plug approach section 3A and the third curved surface section 3C are portions which come into contact with the workpiece 40 (more specifically, the inner surface 40*b* of the workpiece 40) and guide the workpiece 40 to the plug bearing section 3B while reducing the wall thickness of the workpiece 40. In this embodiment, the inner surface 40*b* of the workpiece 40 initially comes into contact not with the plug approach section 3A but with the third curved surface section 3C. In this invention, however, it can be configured such that the inner surface 40*b* of the workpiece 40 initially comes into contact with the plug approach section 3A.

The method of executing the drawing processing of the workpiece 40 using the drawing device 10 of this embodiment is approximately the same as a conventional method, which will be briefly explained below.

Initially, a pointed portion 40*d* smaller than the workpiece 40 in diameter is formed at the tip end portion of the tubular workpiece 40 by swaging, etc. Then, a drawing plug 30 is inserted into and arranged in the hollow portion 40*c* of the workpiece 40, and the tip end (i.e., the pointed portion 40*d*) of the workpiece 40 is inserted into the die hole 21 of the drawing die 20. At this time, the plug bearing section 3B of the drawing plug 30 is arranged at the position corresponding to the die bearing section 2B of the drawing die 20.

Next, the pointed portion 40*d* which is a tip end of the workpiece 40 is chucked with the chucking portion 12*a* of the pulling device 12. Then, as shown in FIG. 1, while applying the lubrication oil 14 to the outer surface 40*a* of the workpiece 40 through the nozzle 13*a* of the lubrication oil supplying device 13, the workpiece 40 is pulled with the pulling device 12 in the drawing direction N so that the drawing rate falls within the range of 10 to 100 m/min, thereby executing the drawing processing of the workpiece 40.

In this drawing processing, as shown in FIGS. 2 and 3, the workpiece 40 is brought into contact with the first curved surface section 1C to be reduced in diameter with the first curved surface section 1C and then detached from the first curved surface section 1C so as to be guided toward the guide section 2D. Then, the workpiece 40 is again brought into contact with the guide section 2D to be reduced in diameter with the guide section 2D and then guided to the die bearing section 2B via the second curved surface section 2C. At this time, the inner surface 40*b* of the workpiece 40 is brought into contact with the third curved surface section 3C and guided to the plug bearing section 3B.

The workpiece 40 passes through between the die bearing section 2B and the plug bearing section 3B, whereby the outer surface 40*a* and the inner surface 40*b* of the workpiece 40 are pressurized by the die bearing section 2B and the plug bearing section 3B, respectively, so that the wall thickness of the workpiece 40 decreases. As a result, the outer diameter size of the workpiece 40 is finished into a target size with the die bearing section 2B. Simultaneously, the outer surface 40*a* of the workpiece 40 is finished into a high smooth surface with the die bearing section 2B. Furthermore, the inner diameter size of the workpiece 40 is finished into a target size with the plug bearing section 3B. Simultaneously, the inner surface 40*b* of the workpiece 40 is finished into a high smooth surface with the plug bearing section 3B.

Through the aforementioned steps, a drawn tube 41 having a high smooth outer surface 41*a* like a surface obtained by polishing processing can be obtained.

Thus, the drawing device 10 of this embodiment has the following advantages.

The die bearing section 2B of the drawing die 20 is arranged radially inward of the workpiece separation point K of the first curved surface section 1C. This configuration allows the workpiece 40 to be reduced in diameter while the workpiece 40 is not in contact with the transition section 1B but prevents the workpiece 40 from being excessively reduced in diameter while the workpiece 40 is being moved from the first curved surface section 1C to the die bearing section 2B. This reduces generation of rough irregularities which cause accumulation of the lubrication oil 14 on the outer surface 40*a* of the workpiece 40. [First Effect]

Furthermore, the second curved surface section 2C of the guide section 2D is smoothly connected to the upstream end F of the die bearing 2B. This allows the workpiece 40 again brought into contact with the guide section 2D to smoothly move toward the die bearing section 2B via the second curved surface section 2C. [Second Effect]

Furthermore, the length L6 of the plug bearing section 3B of the drawing plug 30 is set to be shorter than the length L4 of the die bearing section 2B of the drawing die 20. This assuredly can apply a necessary pressure required for processing the outer surface 40*a* of the workpiece 40 into a high smooth surface to the workpiece 40 from both the plug bearing section 3B and the die bearing section 2B. [Third Effect]

By the synergistic action of the aforementioned first to third effects, the outer surface 40*a* of the workpiece 40 can be processed into a high smooth outer surface 40*a*.

Furthermore, the position of the upstream end G of the plug bearing section 3B of the drawing plug 30 is located at the same as or at the downstream side of the position of the upstream end F of the die bearing section 2B. This assuredly prevents the workpiece 40 from being excessively reduced in diameter while the workpiece 40 again brought into contact with the guide section 2D moves from the guide section 2D to the die bearing section 2B, and also assuredly can apply a pressure necessary to process the workpiece 40 into a high smooth outer surface 40*a* from both the plug bearing section 3B and the die bearing section 2B. This assuredly enables the outer surface 40*a* of the workpiece 40 to be processed into a high smooth surface.

Furthermore, in the cross-section including the die axis X of the drawing die 20, the inclination of the tangent line of the first curved surface section 1C and the inclination of the tangent line of the second curved surface section 2C with respect to the die axis X of the drawing die 20 each gradually decrease as it advances in the drawing direction N of the workpiece 40. This assuredly enables the workpiece 40 to be reduced in diameter with the first curved surface section 1C, and also assuredly guides the workpiece 40 again brought into contact with the guide section 2D to the die bearing section 2B with the second curved surface section 2C.

Furthermore, the curvature radius R21 of the second curved surface section 2C of the drawing die 20 is set to be the same as or smaller than the curvature radius R1 of the first curved surface section 1C. This assuredly enables the outer surface 40*a* of the workpiece 40 to be processed into a high smooth surface. The reasons are as follows. That is, by increasing the curvature radius R1 of the first curved surface section 1C, a sufficient amount of the lubrication oil 14 drawn into between the outer surface 40*a* of the workpiece 40 and the drawing die 20 can be secured. Furthermore, by reducing the curvature radius R21 of the second curved surface section 2C, the surface pressure applied from the second curved surface section 2C to the outer surface 40*a* of the workpiece 40 can be increased. This further restricts generation of oil pits. As a result, the outer surface 40*a* of the workpiece 40 can be more assuredly processed into a high smooth surface.

Further, the guide section 2D has the auxiliary curved surface section 2A smoothly connected to the upstream end of the second curved surface section 2C and curved in a direction opposite to the curving direction of the second curved surface section 2C. This enables assured receiving of the workpiece 40 detached from the first curved surface section 1C by the guide section 2D, resulting in assured guiding of the workpiece 40 from the guide section 2D to the die bearing section 2B.

Furthermore, the length L6 of the plug bearing section 3B of the drawing plug 30 is set to be 5% or more with respect to the length L4 of the die bearing 2B. This enables assured application of a pressure required to process the outer surface 40*a* of the workpiece 40 into a high smooth surface to the workpiece 40 from both the plug bearing section 3B and the die bearing section 2B. Thus, the outer surface 40*a* of the workpiece 40 can be more assuredly processed into a high smooth surface. Further, by setting the length L6 of the plug bearing section 3B to 70% or less with respect to the length L4 of the die bearing section 2B, it becomes possible to assuredly prevent breakage of the workpiece 40 due to the contact friction force between the workpiece 40 and the plug bearing section 3B.

Furthermore, by setting the parallel accuracy of the die bearing section 2B with respect to the die axis X of the drawing die 20 so as to fall within ±3°, the outer surface 40*a* of the workpiece 40 can be more assuredly processed into a high smooth surface.

Furthermore, by setting the parallel accuracy of the plug bearing section 3B with respect to the die axis X of the drawing die 20 so as to fall within ±3°, the outer surface 40*a* of the workpiece 40 can be more assuredly processed into a high smooth surface.

Furthermore, since the length L4 of the die bearing section 2B of the drawing die 20 is 5 mm or more, the outer surface 40*a* of the workpiece 40 can be more assuredly processed into a high smooth surface.

Furthermore, in the radial direction "r" of the drawing die 20, the radial difference H1 between the workpiece separation point K of the first curbed surface section 1C and the die bearing section 2B of the drawing die 20 is set to be 0.3 mm or more, which assuredly prevents the workpiece 40 from being excessively reduced in diameter when the workpiece 40 is moved from the first curved surface section 1C to the die bearing section 2B. Furthermore, since the radial difference is set to be less than 3 mm, when the workpiece 40 again brought into contact with the guide section 2D is guided to the die bearing section 2B, the workpiece 40 can be assuredly prevented from being detached from the die bearing section 2B. Thus, the outer surface 40*a* of the workpiece 40 can be more assuredly processed into a high smooth surface.

Furthermore, the first curved surface section 1C, the guide section 2D, and the die bearing section 2B of the drawing die 20 are integrally formed, which prevents the axial misalignment between the axis of the first curved surface section 1C and the axis of the die bearing section 2B. Thus, the coaxiality of the drawing die 20 can be enhanced. Therefore, by executing the drawing processing of the workpiece 40 using the drawing die 20, the dimensional accuracy of the outer and inner diameters of the drawn tube 41 can be improved assuredly.

Furthermore, since the drawing plug 30 is equipped with the third curved surface section 3C smoothly continued to the upstream end G of the plug bearing section 3B, the workpiece 40 brought into contact with the third curved surface section 3C can be smoothly moved toward the plug bearing section 3B. Thus, the outer surface 40*a* of the workpiece 40 can be more assuredly processed into a high smooth surface.

Furthermore, by pulling the workpiece 40 with the pulling device 12 so that the drawing rate of the drawing tube 41 becomes 10 m/min or more, the drawing processing efficient can be improved. By pulling the workpiece 40 with the pulling device 12 at the drawing rate of 100 m/min or less, the drawn amount of the lubrication oil 14 to be drawn in between the outer surface 40*a* of the workpiece 40 and the drawing die 20 can be prevented from being increased excessively. This prevents the generation of oil-pits more assuredly, which in turn can process the outer surface 40*a* of the workpiece 40 into a high smooth surface more assuredly.

Although an embodiment of the present invention was explained above, the present invention is not limited to the aforementioned embodiment and can be modified variously.

Furthermore, in the present invention, one or a plurality of auxiliary bearing sections and/or diameter-reducing sections which support the material flow of the workpiece 40 can be arranged between the first curved surface section 1C and the guide section 2D of the drawing die 20. Furthermore, in the present invention, one or a plurality of auxiliary bearing sections and/or diameter-reducing sections which support the material flow of the workpiece 40 can be arranged at the upstream side of the first curved surface section 1C of the drawing die 20.

Furthermore, in the present invention, the drawn tube obtained by the drawing processing using the drawing device of the present invention is not limited to a tube used as a photoconductive drum substrate, but can be used in various purposes.

EXAMPLES

Hereinafter, concrete examples of the present invention and comparative examples will be explained.

As workpieces to be drawn in the following examples and comparative examples, aluminum tubular workpieces 40 were prepared. The cross-sectional shape of the workpiece 40 was a circular shape. The material of the workpiece 40 was aluminum alloy corresponding to JIS (Japanese Industrial Standards) A3003 aluminum alloy, one of popular materials used as a workpiece to be drawn. The workpiece 40 was an aluminum extruded tube obtained by extruding an aluminum billet. The outer diameter of the workpiece 40 was 20 mm, and the inner diameter was 17 mm, and the wall thickness was 1.5 mm.

Examples 1-21

Using the drawing device 10 of the embodiment shown in FIGS. 1 to 3, with the drawing rate, the shift amount S of the plug bearing section 3B, and the length L6 of the plug bearing section 3B set variously, each workpiece 40 was once drawn to obtain a drawn tube 41. The outer diameter of the drawn tube 41 was 16.0 mm, the inner diameter was 14.4 mm, and the wall thickness was 0.8 mm. Therefore, the diameter reduction rate Q of the workpiece 40 was 20%. The lubrication oil 14 used at the time of the drawing processing was the product name of "Daphne Master Draw 2594" made by Idemitsu Kosan Co., Ltd. The kinematic viscosity of this lubrication oil 14 at the temperature of 40° C. was 300 to 500 $mm^2/s$. Then, the surface roughness Ry of the outer surface 41*a* of the drawn tube 41 was measured, and the surface roughness of the outer surface 41*a* was evaluated. The results are shown in Table 1.

The size of each section of the drawing die 20 and the drawing plug 30 of the drawing device 10 used in Examples 1 to 21 was as follows.

In the drawing die 20, the die approach half angle θ1 was 30°(θ1=30°), the relief half angle θ2 of the relief section 2E was 20°(θ2=20°), the total length L1 of the die approach section 1A and the first curved surface section 1C which is parallel to the die axis X was 10 mm (L1=10 mm), the length L2 of the transition section 1B parallel to the die axis X was 6 mm (L2=6 mm), the length L3 of the guide section 2D which is parallel to the die axis X was 3 mm (L3=3 mm), the length L4 of the die bearing section 2B was 9 mm (L4=9 mm), the length L5 of the relief section 2E parallel to the die axis X was 2 mm (L5=2 mm), the curvature radius R1 of the first curved surface section 1C was 4 mm (R1=4 mm), the curvature radius R21 of the second curved surface section 2C of the guide section 2D was 4 mm (R21=4 mm), the curvature radius R22 of the auxiliary curved surface section 2A of the guide section 2D was 2 mm (R22=2 mm), in the radial direction "r" of the drawing die 20, the radial difference H2 between the transition section 1B and the die bearing section 2B was 0.5 mm (H2=0.5 mm), and the radial difference H1 between the workpiece separation point K of the first curved surface section 1C and the die bearing section 2B was 0.6 mm (H1=0.6 mm). The parallel accuracy of the die bearing section 2B with respect to the die axis X of the drawing die 20 was set so as to fall within ±3°.

In the drawing plug 30, the diameter Dp of the plug bearing section 3B was 14.4 mm (Dp=14.4 mm), the curvature radius R3 of the third curved surface section 3C was 50 mm (R3=50 mm), the plug approach half angle θ3 was 20° (θ3=20°). When the length L6 of the plug bearing section 3B was 0, 1, 2, and 5 mm, the ratio of the length L6 of the plug bearing section 3B with respect to the length L4 of the die bearing section 2B was 0, 11, 22, and 56%, respectively. The parallel accuracy of the plug bearing section 3B with respect to the die axis X of the drawing die 20 was set so as to fall within ±3°.

Furthermore, the "shift amount S of the plug bearing section" denotes a shift amount of the position of the upstream end G of the plug bearing section 3B shifted toward the downstream side with respect to the position of the upstream end F of the die bearing section 2B. The positive and negative signs of the shift amount S were mentioned above.

The symbols in the surface roughness in Table 1 denotes as follows.

Ry was 1.0 μm or less (i.e., Ry≤1.0 μm)

○ Ry exceeded 1.0 μm but less than 2.0 μm (i.e., 1.0 μm<Ry<2.0 μm)

Ry was 2.0 μm or more (i.e., Ry≥2.0 μm)

x Workpiece was broken, or drawing processing could not be executed

The surface roughness Ry of the outer surface 41*a* of the drawn tube 41 was an average value of five surface roughness values measured at five points in the circumferential direction and the longitudinal direction respectively on the outer surface 41*a* of the drawn tube 41 with the laser surface roughness measuring device (probe length of the laser was 2 μm). The measurements were performed in accordance with JIS B 0601: 1994.

Comparative Example 1

Under the same processing conditions as in Examples 1-21 except that the length L6 of the plug bearing section 3B of the drawing plug 30 of the drawing device 10 used in Examples 1-21 was set to 15 mm longer than the length L4 of the die bearing section 2B, the workpiece 40 was subjected to the drawing processing to thereby produce a drawn tube 41. The surface roughness Ry of the outer surface 41*a* of the drawn tube 41 was measured to evaluate the surface roughness of the outer surface 41*a*. The results are shown in Table 1.

TABLE 1

| | Drawing rate (m/min) | Shift amount S of plug bearing section (mm) | Length L6 of plug bearing section (mm) | Surface roughness |
|---|---|---|---|---|
| Example 1 | 10 | 0 | 0 | ○ |
| Example 2 | 10 | 0 | 1 | ◎ |
| Example 3 | 10 | 0 | 2 | ◎ |
| Example 4 | 10 | 0 | 5 | ○ |
| Example 5 | 30 | −2 | 0 | Δ |
| Example 6 | 30 | −2 | 1 | ○ |
| Example 7 | 30 | −2 | 2 | ○ |
| Example 8 | 30 | −2 | 5 | Δ |
| Example 9 | 30 | 0 | 0 | ○ |
| Example 10 | 30 | 0 | 1 | ◎ |
| Example 11 | 30 | 0 | 2 | ◎ |
| Example 12 | 30 | 0 | 5 | ○ |
| Example 13 | 30 | 2 | 0 | ○ |
| Example 14 | 30 | 2 | 1 | ◎ |
| Example 15 | 30 | 2 | 2 | ◎ |
| Example 16 | 30 | 2 | 5 | ○ |
| Example 17 | 50 | 0 | 0 | ○ |
| Example 18 | 50 | 0 | 1 | ◎ |
| Example 19 | 50 | 0 | 2 | ◎ |
| Example 20 | 50 | 0 | 5 | ○ |
| Example 21 | 100 | 0 | 1 | Δ |
| Comparative Example 1 | 30 | 0 | 15 | X |

As shown in Examples 1-21 in Table 1, when the workpiece 40 was drawn using the drawing device 10 of this embodiment in which the length L6 of the plug bearing section 3B of the drawing plug 30 was set to be shorter than the length L4 of the die bearing section 2B, the outer surface 40*a* of the workpiece 40 could be processed into a high smooth surface.

On the other hand, as shown in Comparative Example 1, when the workpiece 40 was drawn using the drawing device 10 of this embodiment in which the length L6 of the plug bearing section 3B of the drawing plug 30 was set to be longer than the length L4 of the die bearing section 2B, since the contact friction force between the workpiece 40 and the drawing plug 30 was excessively large, the workpiece 40 was broken (or the drawing processing could not be executed).

Comparative Examples 2, 3

Figure 4:
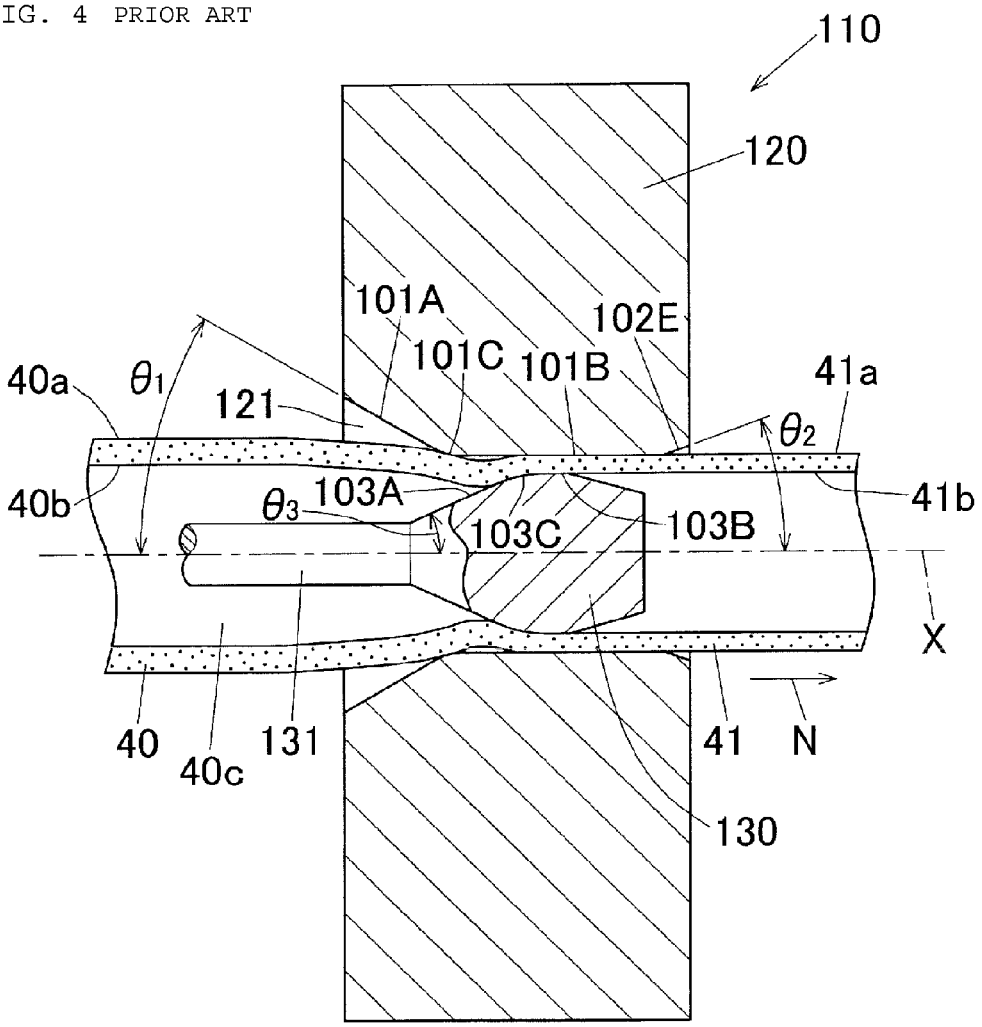
FIG. 4 PRIOR ART
FIG. 4 is a vertical cross-section view of the drawing die and the drawing plug in a state in which a workpiece is being drawn by a conventional device for drawing a tubular workpiece.
Figure 5:
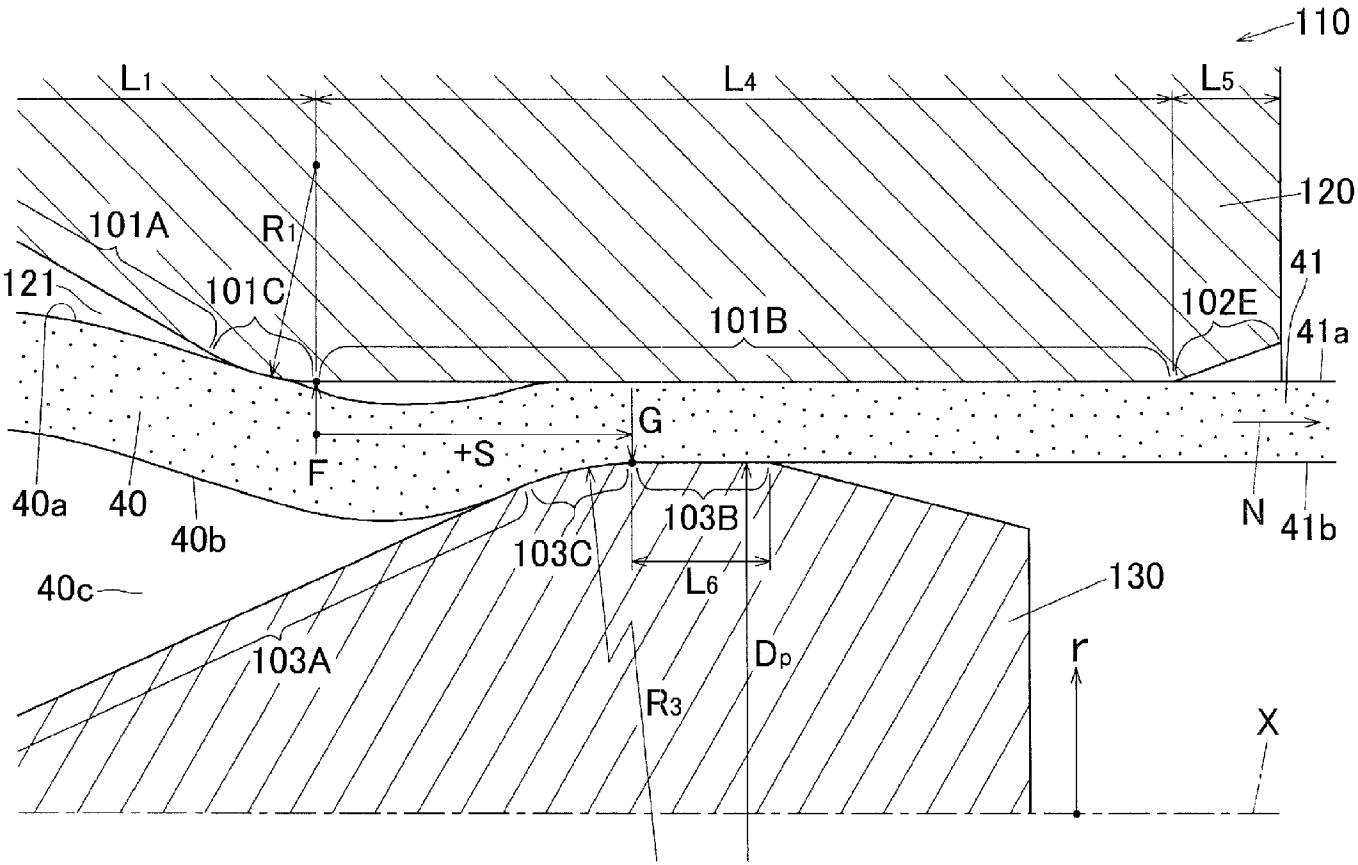
FIG. 5 PRIOR ART
FIG. 5 is an enlarged view of FIG. 4.

Under the same processing conditions as in Examples 1-21 except that a conventional drawing device 110 shown in FIGS. 4 and 5 was used, the workpiece 40 was subjected to the drawing processing to thereby produce a drawn tube 41. The surface roughness Ry of the outer surface 41*a* of the drawn tube 41 was measured to evaluate the surface roughness of the outer surface 41*a*. The results are shown in Table 2.

The size of each section of the drawing die 120 and the drawing plug 130 of the drawing device 110 used in Comparative Examples 2 and 3 was as follows.

In the drawing die 120, the die approach half angle θ1 was 30° (θ1=30°), the relief half angle θ2 of the relief section 102E was 20° (θ2=20°), the total length L1 of the die approach section 101A and the first curved surface section 101C parallel to the die axis X was 10 mm (L1=10 mm), the length L4 of the die bearing section 101B was 20 mm (L4=20 mm), the length L5 of the relief section 102E parallel to the die axis X was 2 mm (L5=2 mm), and the curvature radius R1 of the curved surface section 101C was 4 mm (R1=4 mm).

In the drawing plug 130, the diameter Dp of the plug bearing section 103B was 14.4 mm (Dp=14.4 mm), the length L6 of the plug bearing section 103B was 2 mm (L6=2 mm), the curvature radius R3 of the curved surface section 103C between the plug bearing section 103B and the plug approach section 103A was 50 mm (R3=50 mm), the plug approach half angle θ3 was 18° (θ3=18°). The shift amount S of the plug bearing section 103B was 2 mm (S=2 mm). The shift amount S of the plug bearing section 103B denotes a shift amount of the position of the upstream end G of the plug bearing section 103B shifted toward the downstream side with respect to the position of the upstream end F of the die bearing section 101B.

TABLE 2

| | Drawing rate (m/min) | Shift amount S of plug bearing section (mm) | Length L6 of plug bearing section (mm) | Surface roughness |
|---|---|---|---|---|
| Comparative Example 2 | 30 | 2 | 2 | ○ |
| Comparative Example 3 | 50 | 2 | 2 | Δ |

As shown in Comparative Examples 2 and 3 in Table 2, in cases where the workpiece 40 was subjected to the drawing processing using a conventional drawing device 110, the surface roughness of the outer surface 40*a* of the workpiece 40 was poor as compared with the case in which the workpiece 40 was subjected to the drawing processing using the drawing device 10 of this embodiment.

Examples 22-26

The workpiece 40 was subjected to the drawing processing while variously changing the drawing rate and the shift amount S of the plug bearing section 3B using the drawing device 10 according to the embodiment shown in FIGS. 1 to 3, to thereby produce a drawn tube 41. The surface roughness Ry of the outer surface 41*a* of the drawn tube 41 was measured to evaluate the surface roughness of the outer surface 41*a*. The results are shown in Table 3.

In the drawing device 10 used in Examples 22-26, the curvature radius R1 of the first curved surface section 1C and the curvature radius R21 of the second curved surface section 2C of the guide section 2D of the drawing die 20 were different from those of Examples 1-21, i.e., the curvature radius R1 of the first curved surface section 1C was 4 mm (R1=4 mm), and the curvature radius R21 of the second curved surface section 2C was mm (R21=3 mm). The other size and drawing processing conditions of the drawing device 10 were the same as those of Examples 1 to 21.

TABLE 3

| | Drawing rate (m/min) | Shift amount S of plug bearing section (mm) | Length L6 of plug bearing section (mm) | Surface roughness |
|---|---|---|---|---|
| Example 22 | 10 | 0 | 2 | ◎ |
| Example 23 | 30 | −2 | 2 | ○ |
| Example 24 | 30 | 0 | 2 | ◎ |
| Example 25 | 30 | 2 | 2 | ◎ |
| Example 26 | 50 | 0 | 2 | ◎ |

As shown in Examples 22 to 26 in Table 3, even in cases where the workpiece 40 was subjected to the drawing processing using the drawing device 10 in which the curvature radius R21 of the second curved surface section 2C of the drawing die 20 was set to be shorter than the curvature radius R1 of the first curved surface section 1C, it was confirmed that the outer surface 40*a* of the workpiece 40 could be processed into a high smooth surface.

Examples 27-31

The workpiece 40 was subjected to the drawing processing while variously changing the drawing rate and the shift amount S of the plug bearing section 3B using the drawing device 10 according to the embodiment shown in FIGS. 1 to 3, to thereby produce a drawn tube 41. The surface roughness Ry of the outer surface 41*a* of the drawn tube 41 was measured to evaluate the surface roughness of the outer surface 41*a*. The results are shown in Table 4.

In the drawing device 10 used in Examples 27 to 31, the radial difference H1 between the workpiece separation point K of the first curved surface section 1C and the die bearing section 2B of the drawing die 20 was different from that of Examples 1 to 21, i.e., the radial difference H1 was 1.0 mm (H1=1.0 mm). The other size and drawing processing conditions of the drawing device 10 were the same as those of Examples 1 to 21.

TABLE 4

| | Drawing rate (m/min) | Shift amount S of plug bearing section (mm) | Length L6 of plug bearing section (mm) | Surface roughness |
|---|---|---|---|---|
| Example 27 | 10 | 0 | 2 | ◎ |
| Example 28 | 30 | −2 | 2 | ○ |
| Example 29 | 30 | 0 | 2 | ◎ |
| Example 30 | 30 | 2 | 2 | ◎ |
| Example 31 | 50 | 0 | 2 | ◎ |

As shown in Examples 27 to 31 in Table 4, even in cases where the workpiece 40 was subjected to the drawing processing using the drawing device 10 of this embodiment in which the radial difference H1 between the workpiece separation point K of the first curved surface section 1C and the die bearing section 2B of the drawing die 20 was set to be different from that of Examples 1 to 21, it was confirmed that the outer surface 40*a* of the workpiece 40 could be processed into a high smooth surface.

This application claims priority to Japanese Patent Application No. P2008-213044 filed on Aug. 21, 2008, the entire disclosure of which is incorporated herein by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The present invention can be applied to a device for drawing a tubular workpiece, a drawing die, and a method of drawing a tubular workpiece, capable of obtaining a drawn tube having a high smooth surface.

DESCRIPTION OF SYMBOLS

10 drawing device
12 pulling device
20 drawing die
1A die approach section
1B transition section
1C first curved surface section
2A auxiliary curved surface section
2B die bearing section
2C second curved surface section
2D guide section
30 drawing plug
3A plug approach section
3B plug bearing section
3C third curved surface section
40 workpiece
40*a* outer surface
41 drawn tube 41*a* outer surface
X die axis of the drawing die
N drawing direction of the workpiece

The invention claimed is:

1. A device for drawing a tubular workpiece, comprising:
a drawing die for processing an outer surface of the tubular workpiece; and
a drawing plug arranged in a hollow portion of the workpiece to process an inner surface of the workpiece,
wherein the drawing die includes:
a first curved surface section including a workpiece separation point at which the workpiece is detached from the first curved surface section while being reduced in diameter;
a transition section downstream of the workpiece separation point of the first curved surface section, the first curved surface section and the transition section being configured such that the workpiece is not in contact with the transition section and the workpiece is further reduced in diameter while the workpiece is in the transition section;
a die bearing section arranged radially inward of and downstream of the workpiece separation point of the first curved surface section; and
a guide section including a second curved surface section smoothly continuing to an upstream end of the die bearing section and configured to again come into contact with the workpiece detached from the first curved surface section to guide the workpiece to the die bearing section while reducing a diameter of the workpiece,
wherein the drawing plug has a plug bearing section arranged at a position corresponding to the die bearing section and shorter than the die bearing section, and
wherein the first curved surface section, the transition section, the guide section, and the die bearing section of the drawing die are integrally formed.

2. The device for drawing a tubular workpiece as recited in claim 1, wherein a position of an upstream end of the plug bearing section is arranged at the same as or at a downstream side of a position of an upstream end of the die bearing section.

3. The device for drawing a tubular workpiece as recited in claim 1, wherein in a cross-section including a die axis of the drawing die, an inclination of a tangent line of the first curved surface section with respect to the die axis of the drawing die and an inclination of a tangent line of the second curved surface section with respect to the die axis of the drawing die each gradually decrease as it advances in a drawing direction of the workpiece.

4. The device for drawing a tubular workpiece as recited in claim 1, wherein a curvature radius of the second curved surface section is set to be equal to or smaller than a curvature radius of the first curved surface section.

5. The device for drawing a tubular workpiece as recited in claim 1, wherein the guide section includes an auxiliary curved surface section which smoothly continues to an upstream end of the second curved surface section and curves in a direction opposite to a curving direction of the second curved surface section.

6. The device for drawing a tubular workpiece as recited in claim 1, wherein a length of the plug bearing section in a drawing direction of the workpiece is set so as to fall within a range of 5 to 70% of a length of the die bearing section in the drawing direction.

7. The device for drawing a tubular workpiece as recited in claim 1, wherein an axis of the die bearing section is parallel to a die axis of the drawing die or substantially parallel to within ±3°.

8. The device for drawing a tubular workpiece as recited in claim 1, wherein an axis of the plug bearing section is parallel to a die axis of the drawing die or substantially parallel to within ±3°.

9. The device for drawing a tubular workpiece as recited in claim 1, wherein a length of the die bearing section in a drawing direction of the workpiece is 5 mm or more.

10. The device for drawing a tubular workpiece as recited in claim 1, wherein a distance between the workpiece separation point of the first curved surface section and the die bearing section in a radial direction of the drawing die is set to be 0.3 mm or more but less than 3 mm.

11. The device for drawing a tubular workpiece as recited in claim 1, wherein the drawing plug is provided with a third curved surface section which smoothly continues to an upstream end of the plug bearing section.

12. The device for drawing a tubular workpiece as recited in claim 1, further comprising a pulling device for pulling the workpiece in a drawing direction so that a drawing rate falls within a range of 10 to 100 m/min.

13. A drawing die for processing an outer surface of a tubular workpiece, comprising:
a first curved surface section including a workpiece separation point at which the workpiece is detached from the first curved surface section while being reduced in diameter;
a transition section downstream of the workpiece separation point of the first curved surface section, the first curved surface section and the transition section being configured such that the workpiece is not in contact with the transition section and the workpiece is further reduced in diameter while the workpiece is in the transition section;
a die bearing section arranged radially inward of and downstream of the workpiece separation point of the first curved surface section; and
a guide section including a second curved surface section which smoothly continues to an upstream end of the die bearing section and configured to again come into contact with the workpiece detached from the first curved surface section to guide the workpiece to the die bearing section while reducing a diameter of the workpiece, wherein
the first curved surface section and the transition section are configured such that the workpiece is further reduced in diameter while the workpiece is in the transition section; and
the first curved surface section, the transition section, the guide section, and the die bearing section of the drawing die are integrally formed.

14. The drawing die as recited in claim 13, wherein the drawing die is used in combination with a drawing plug disposed in a hollow portion of the workpiece to process an inner surface of the workpiece.

15. A method of drawing a tubular work piece using the device for drawing a tubular workpiece as recited in claim 1.

16. A method of drawing a tubular workpiece with a drawing device equipped with a drawing die for processing an outer surface of the tubular workpiece and a drawing plug arranged in a hollow portion of the workpiece to process an inner surface of the workpiece, the method comprising the steps of:

detaching the workpiece from a first curved surface section of the drawing die while reducing a diameter of the workpiece;

further reducing the diameter of the workpiece in a transition section downstream of the first curved surface section while the workpiece is detached from the drawing die and not in contact with the transition section; then guiding the workpiece to a die bearing section which smoothly continues to a second curved surface section of the guide section while reducing the diameter of the workpiece by again bringing the workpiece into contact with the guide portion of the drawing die; and making the workpiece pass between the die bearing section and a plug bearing section of the drawing plug to process an outer surface of the workpiece; wherein the first curved surface section, the transition section, the guide section, and the die bearing section of the drawing die are integrally formed.

17. The method of drawing a tubular workpiece as recited in claim 16, wherein the die bearing section is arranged radially inward of and downstream of a workpiece separation point of the first curved surface section, wherein a length of the plug bearing section in a drawing direction of the workpiece is set to be shorter than a length of the die bearing section in the drawing direction, and wherein a position of an upstream end of the plug bearing section is arranged at the same as or at a downstream side of a position of an upstream end of the die bearing section.

18. The method of drawing a tubular workpiece as recited in claim 16, wherein in a cross-section including a die axis of the drawing die, an inclination of a tangent line of the first curved surface section with respect to the die axis of the drawing die and an inclination of a tangent line of the second curved surface section with respect to the die axis of the drawing die each gradually decrease as it advances in a drawing direction of the workpiece.

19. The method of drawing a tubular workpiece as recited in claim 16, wherein a curvature radius of the second curved surface section is set to be equal to or smaller than a curvature radius of the first curved surface section.

20. The method of drawing a tubular workpiece as recited in claim 16, wherein the guide section includes an auxiliary curved surface section which smoothly continues to an upstream end of the second curved surface section and curves in a direction opposite to a curving direction of the second curved surface section.

21. The method of drawing a tubular workpiece as recited in claim 16, wherein a length of the plug bearing section in a drawing direction of the workpiece is set so as to fall within a range of 5 to 70% of a length of the die bearing section in the drawing direction.

22. The method of drawing a tubular workpiece as recited in claim 16, wherein an axis of the die bearing section is parallel to a die axis of the drawing die or substantially parallel to within ±3°.

23. The method of drawing a tubular workpiece as recited in claim 16, wherein an axis of the plug bearing section is parallel to a die axis of the drawing die or substantially parallel to within ±3°.

24. The method of drawing a tubular workpiece as recited in claim 16, wherein a length of the die bearing section in a drawing direction of the workpiece is 5 mm or more.

25. The method of drawing a tubular workpiece as recited in claim 16, wherein in a radial direction of the drawing die, a distance between a workpiece separation point of the first curved surface section and the die bearing section is set to be 0.3 mm or more but less than 3 mm.

26. The method of drawing a tubular workpiece as recited in claim 16, wherein the drawing plug is provided with a third curved surface section which smoothly continues to an upstream end of the plug bearing section.

27. The method of drawing a tubular workpiece as recited in claim 16, wherein the drawing of the workpiece is performed in a state in which a drawing rate is set so as to fall within a range of 10 to 100 mm/min.

* * * * *